US008726436B2

(12) United States Patent
Wright

(10) Patent No.: US 8,726,436 B2
(45) Date of Patent: May 20, 2014

(54) BACK SLEEPING ONLY PILLOW

(71) Applicant: Louisa Carlotta Wright, Castle Rock, CO (US)

(72) Inventor: Louisa Carlotta Wright, Castle Rock, CO (US)

( * ) Notice: Subject to any disclaimer, the term of this patent is extended or adjusted under 35 U.S.C. 154(b) by 0 days.

(21) Appl. No.: 13/890,483

(22) Filed: May 9, 2013

(65) Prior Publication Data

US 2014/0075675 A1 Mar. 20, 2014

Related U.S. Application Data

(60) Provisional application No. 61/744,088, filed on Sep. 18, 2012.

(51) Int. Cl.
*A47G 9/10* (2006.01)

(52) U.S. Cl.
USPC ..... 5/637; 5/636; D6/601

(58) Field of Classification Search
USPC ..... 5/637, 636, 644, 490; D6/601
See application file for complete search history.

(56) References Cited

U.S. PATENT DOCUMENTS

| | | | | | |
|---|---|---|---|---|---|
| 1,385,355 | A | * | 7/1921 | Banks | 5/636 |
| 2,880,428 | A | * | 4/1959 | Forsland | 5/636 |
| D248,141 | S | * | 6/1978 | Forsland | D6/601 |
| 4,528,705 | A | * | 7/1985 | Greenawalt | 5/644 |
| 4,832,007 | A | * | 5/1989 | Davis et al. | 250/580 |
| D306,112 | S | * | 2/1990 | Forsland | D6/601 |
| D306,245 | S | * | 2/1990 | Akhtarekhavari | D6/601 |
| D307,368 | S | * | 4/1990 | Lockhart et al. | D6/601 |
| D308,311 | S | * | 6/1990 | Forsland | D6/601 |
| D376,288 | S | * | 12/1996 | Antonian | D6/601 |
| 5,797,154 | A | * | 8/1998 | Contreras | 5/636 |
| D402,150 | S | * | 12/1998 | Wurmbrand et al. | D6/601 |
| 6,327,725 | B1 | * | 12/2001 | Veilleux et al. | 5/644 |
| 6,345,401 | B1 | * | 2/2002 | Frydman | 5/636 |
| 6,978,502 | B2 | * | 12/2005 | Calagui | 5/640 |
| 7,013,512 | B1 | * | 3/2006 | Hsu | 5/636 |
| 7,681,263 | B1 | * | 3/2010 | Hawkins | 5/640 |
| D691,828 | S | * | 10/2013 | Rosenberg | D6/601 |
| D696,045 | S | * | 12/2013 | Marinkovic | D6/601 |
| 2003/0000019 | A1 | * | 1/2003 | Glaze | 5/636 |
| 2004/0139550 | A1 | * | 7/2004 | Calagui | 5/636 |
| 2009/0139031 | A1 | * | 6/2009 | Davis et al. | 5/639 |
| 2012/0060292 | A9 | * | 3/2012 | Davis | 5/636 |
| 2013/0283534 | A1 | * | 10/2013 | Marinkovic | 5/636 |

* cited by examiner

*Primary Examiner* — Robert G Santos
(74) *Attorney, Agent, or Firm* — Oakwood Law Group, LLP

(57) ABSTRACT

A sleeping pillow to promote only sleeping in the supine position by keeping the said user from sleeping on their side or belly. Constructed of three components; a contoured middle section where the head and neck rest upon and two identical opposing side mounds that flank the middle section. The side mounds prevent the said user from turning their head too much to either side when sleeping in the supine position. The three components of the pillow function as one unit and are covered in a form fitted fabric case with a zipper closure.

1 Claim, 6 Drawing Sheets

BACK SLEEPING ONLY PILLOW

RELATED APPLICATIONS

This application claims priority and is entitled to the filing date of U.S. Provisional application Ser. No. 61/744,088 filed Sep. 18, 2012 and entitled "Back Sleeping Only Pillow." The contents of the aforementioned application are incorporated by reference herein.

FIELD OF THE INVENTION

The present invention relates to a pillow and relates more particularly to a pillow with a profile designed to keep the said person sleeping supine when on a sleeping surface.

BACKGROUND OF THE INVENTION

There is a plethora of pillows on the market that take into consideration the various positions a given person prefers to sleep in. These are made to accommodate the sleeper's habitual sleep positions. What has not been available is a pillow that supports the sleeper's desired or chosen sleep position. Just because the sleeper finds comfort in a particular position does not mean it is the position he desires to sleep in. It is well known that supine is best position for a sleeper's body with many benefits. Learning or training oneself to sleep on their back takes time and discipline. A pillow that limits the choice of sleep positions to only on your back will help any sleeper achieve this desired sleep position.

SUMMARY OF THE INVENTION

A pillow to assist and train a person to fall asleep and remain in a supine position when lying horizontally on a sleeping surface. A contoured center section of the pillow supports the user's neck and head while on each opposing end of the center section are rounded bolster-like mounds that prevent extended turning of the head. The pillow's opposing side mounds surround the sleeper's head and interrupt turning to reposition the body onto the side or belly while asleep. Additionally, the pillow does not allow for comfortable or appropriate side or belly sleep.

DETAILED DESCRIPTION OF PREFERRED EMBODIMENTS

Figure 1:
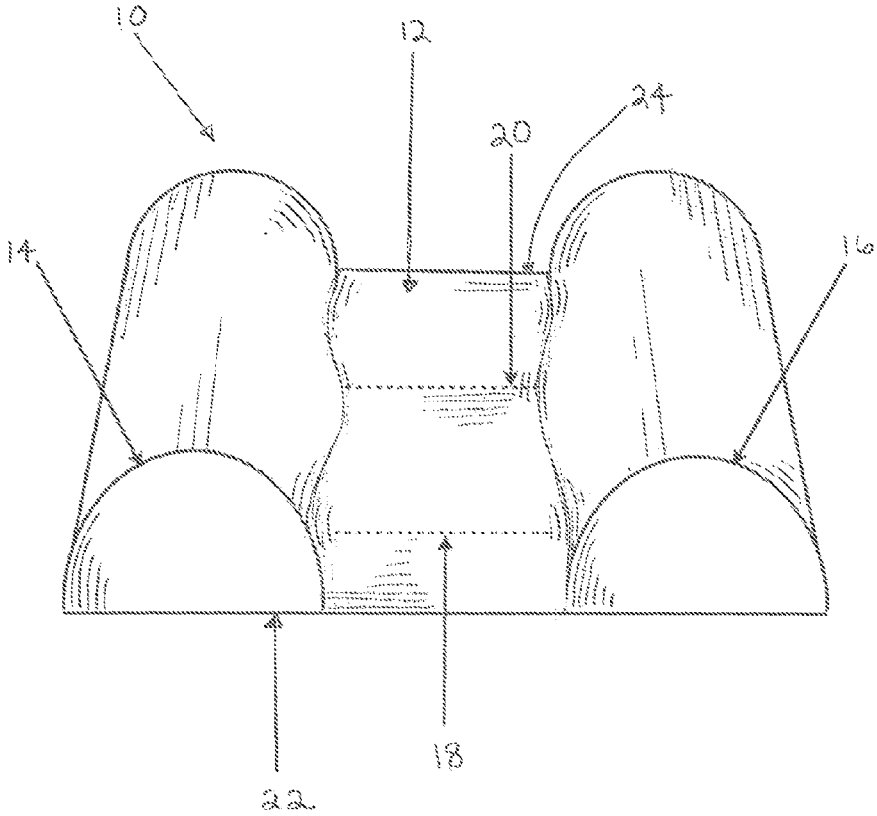
FIG. 1. is a perspective view of a pillow according to at least one embodiment of the pillow disclosed herein.

Referring now to the invention in more detail, in FIG. 1 there is shown the pillow 10 having a lower, contoured middle section 12 and raised mounds 14, 16 on each end. The highest point 18 of the middle section 12 is toward the front of the pillow 10 and the lowest point 20 is toward the back side. The bottom 22 of the pillow 10 is completely flat.

Figure 2:
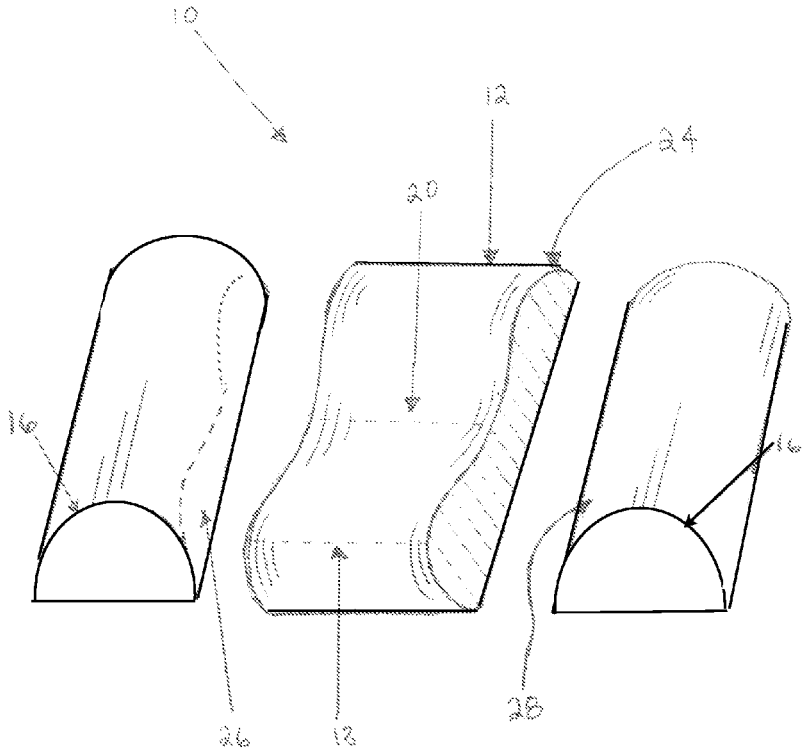
FIG. 2. is an exploded view of a pillow according to at least one embodiment of the pillow disclosed herein.

Referring now to the invention in more detail, in FIG. 2 there is shown an exploded view of the pillow 10 where the end mounds 14, 16 are separated from the middle section 12. The side mounds 14, 16 each attach to the contoured center section 12 at the innermost lower portions 26, 28 of each mound 14, 16. The highest point 18 of the center section 12 is in the forward of the pillow 10 while the lowest point 20 is positioned toward the back.

Figure 3:
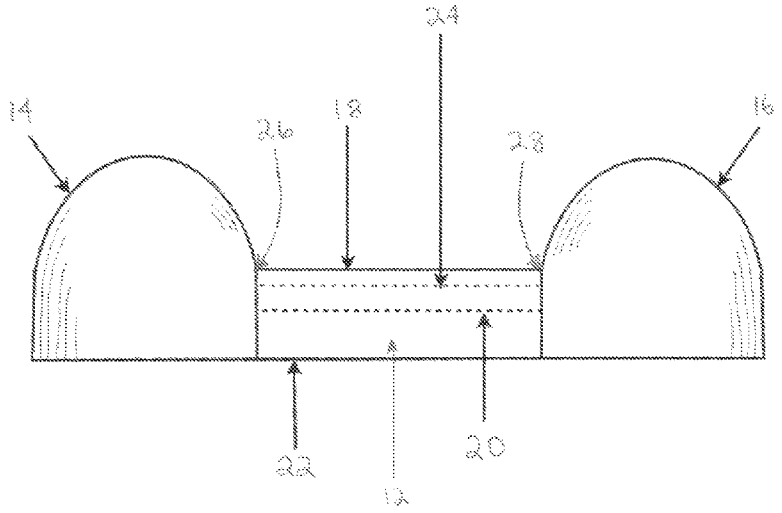
FIG. 3. is a front view of a pillow according to at least one embodiment of the pillow disclosed herein.

Referring now to the invention in more detail, in FIG. 3 there is shown the front or face of the pillow 10. The mounds 14, 16 are considerably higher than the middle section 12. The dotted line 20 is the lowest point of the middle section 12, while the dotted line 24 shows where the back of the middle section 12 lies. Points 26, 28 show where the side mounds 14, 16 connect to the middle section 12 of the pillow 10.

Figure 4:
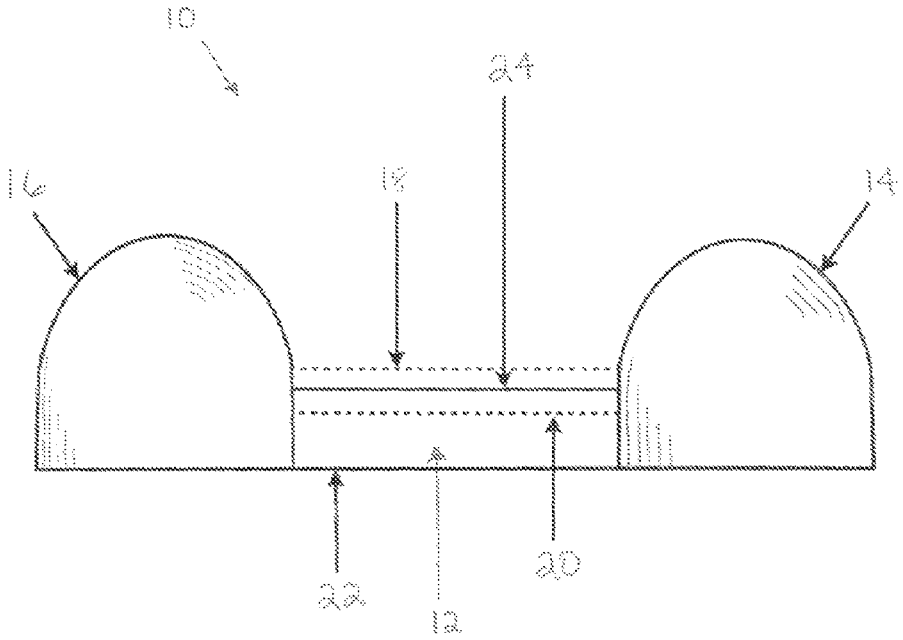
FIG. 4. is a back view of a pillow according to at least one embodiment of the pillow disclosed herein.

Referring now to the invention in more detail, in FIG. 4 there is shown the back 24 or rear of the pillow 10. The highest point 18 of the midsection is now positioned in the furthermost portion of the midsection 12 while the lowest 20 is now positioned toward the front. The raised mounds 14, 16 on each side are the same structurally in the front 30 as they are in the back 24.

Figure 5:
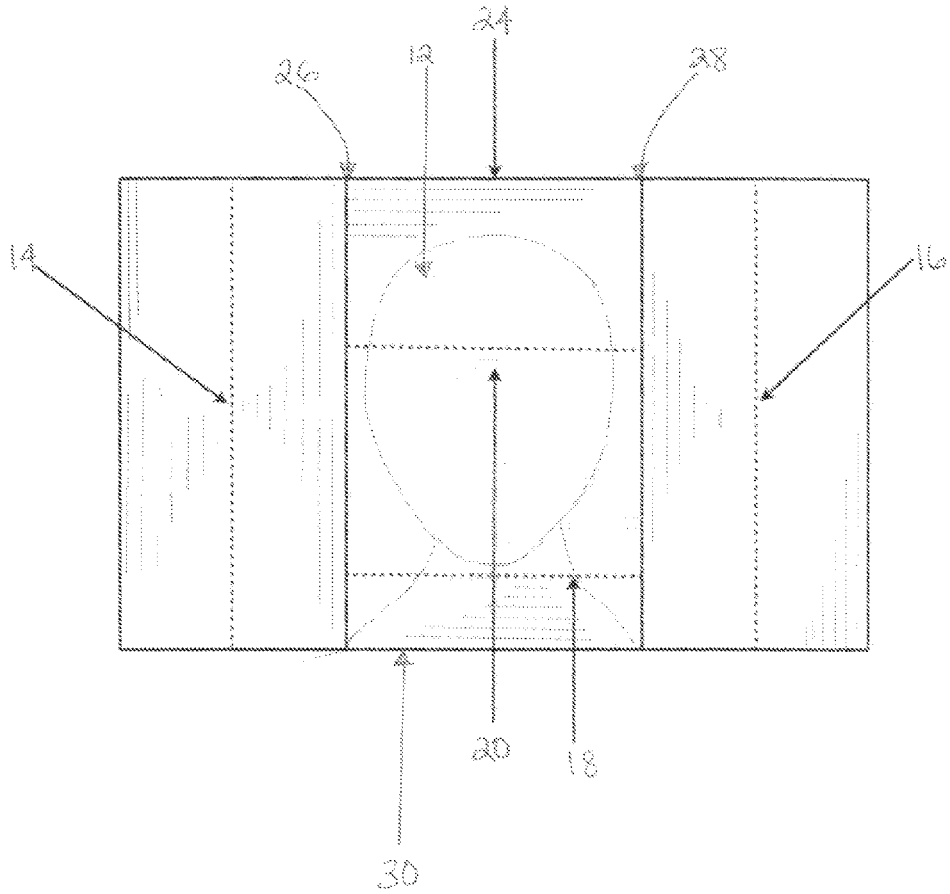
FIG. 5. is a top view of a pillow according to at least one embodiment of the pillow disclosed herein.

Referring now to the invention in more detail, in FIG. 5 there is shown a top or aerial view of the pillow 10. The front 30 of the pillow is shown to have the highest contour 18 of the pillow 10 is toward the front while the lowest point 20 is toward the back 24 of the pillow 10 midsection 12. The dotted lines on the two side mounds 14, 16 show their topmost or highest level.

Figure 6:
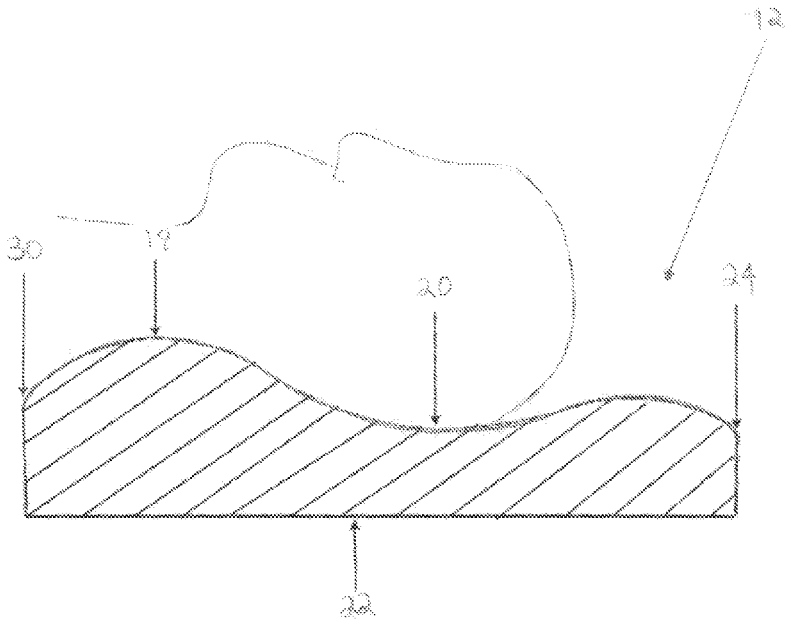
FIG. 6. is a side view of a pillow according to at least one embodiment of the pillow disclosed herein.

Referring now to the invention in more detail, in FIG. 6 there is shown the cross-section of the middle section 12 of the pillow 10. The lowest part 20 is between the highest point 18 and the back 24 of the middle section 12 creating the dip part of the contour. The front 30 of the middle section 12 is on the left side of FIG. 6. Though the front 30 of the midsection 12 is still higher than the back 24, it is still not as high as the midsection's 12 highest point 18.

In further detail, still referring to the invention of FIG. 1, the pillow 10 has a middle section 12 wide enough to accommodate the human head, such as about 8 inches, yet the side mounds 14, 16 are placed on either side to prevent the head from turning too much to one side which would disrupt repositioning while asleep.

The construction details of the invention as shown in FIG. 1 are that the pillow may be made of foam or memory foam or any other sufficiently soft material such as feathers, cotton or the like.

The advantages of the present invention include, without limitation, a comfortable sleeping device that will train the sleeper to remain on their back while sleeping. The typical bed pillow allows all sleeping positions, including but not limited to, on the back, on either side, on the belly. The present invention includes only on the back sleeping. The side mounds in the present invention are unique and not provided with a typical bed pillow.

In broad embodiment, the present invention is a pillow with an elevated contour midsection and raised side mounds and is to be placed at the top of the bed to use as a sleeping device where the head lays.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

The embodiments of the invention in which an exclusive property or privilege is claimed are defined as follows:

1. A pillow for assisting and training a user to remain in the supine position while asleep and in deterring a user from repositioning onto the side or belly while lying on a sleeping surface, comprising:

a contoured memory foam midsection supporting the user's head and curvature of the neck, having a highest point at a front portion of the midsection, a lowest point in a middle portion of the midsection, and a back portion of the midsection with a height between that of the highest point and the lowest point, and the midsection's front portion situated as to support the nape of user's neck while the middle portion is situated as to hold the weight and shape of user's head;

two identical opposing side mounds, in the shape of elongated half circles, flatted on a bottom and rounded at a top of, projecting vertically from each opposite end of the pillow's midsection such that when a user turns his head to one side with the intention of repositioning onto his side or belly, the process will be halted.

* * * * *